US010725407B2

(12) United States Patent
Morihara et al.

(10) Patent No.: US 10,725,407 B2
(45) Date of Patent: Jul. 28, 2020

(54) FIXING APPARATUS

(71) Applicant: CANON KABUSHIKI KAISHA, Tokyo (JP)

(72) Inventors: Ryo Morihara, Tokyo (JP); Masahiko Suzumi, Yokohama (JP); Tomoo Akizuki, Kawasaki (JP); Tatsuya Kinukawa, Kawasaki (JP); Takeharu Nakada, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/356,945

(22) Filed: Mar. 18, 2019

(65) Prior Publication Data

US 2019/0302664 A1 Oct. 3, 2019

(30) Foreign Application Priority Data

Mar. 30, 2018 (JP) ..... 2018-068244

(51) Int. Cl.
*G03G 15/20* (2006.01)

(52) U.S. Cl.
CPC ..... *G03G 15/2053* (2013.01); *G03G 15/2064* (2013.01); *G03G 2215/2016* (2013.01)

(58) Field of Classification Search
CPC ..... G03G 15/2053; G03G 15/2064; G03G 2215/2016
See application file for complete search history.

(56) References Cited

U.S. PATENT DOCUMENTS

2008/0219723 A1* 9/2008 Lee ..... G03G 15/2064 399/329
2016/0274511 A1* 9/2016 Ogino ..... G03G 15/2053
2018/0373186 A1* 12/2018 Sato ..... G03G 15/2053

FOREIGN PATENT DOCUMENTS

JP 4599189 B2 12/2010

* cited by examiner

*Primary Examiner* — Gregory H Curran
(74) *Attorney, Agent, or Firm* — Canon U.S.A., Inc. IP Division

(57) ABSTRACT

A fixing apparatus includes a holding member including a groove-like holding portion, a heater supported by the holding portion, a film rotatable around the heater, the film being configured to be heated by sliding on the heater and to heat a toner image on a printing material, and a gap filling member including, on an upstream side with respect to the heater in a direction in which the circumferential surface of the film moves, a first portion disposed between the heater and the holding member and a first contact portion connecting to the first portion and being in contact with the film. A second distance between the first portion and the holding member disposed upstream from the first portion and facing the first portion is smaller than a first distance between the heater and the first portion disposed upstream from the heater and facing the holding member.

11 Claims, 10 Drawing Sheets

FIXING APPARATUS

BACKGROUND OF THE DISCLOSURE

Field of the Disclosure

The present disclosure relates to fixing apparatuses for use in image forming apparatuses, such as electrophotographic copying machines and laser printers. An example of the fixing apparatuses is a fixing apparatus that thermally fixes unfixed toner images formed on a printing material (for example, paper) to the printing material.

Description of the Related Art

Known toner fixing apparatuses for use in an electrophotographic method are of a heat roller type and a film heating type. Fixing apparatuses of the film heating type (for example, Japanese Patent No. 4599189) include a heater having a resistive heating element on a ceramic substrate, a fixing film that rotates while being heated in contact with the heater, and a pressure roller that forms a nip with the heater with the fixing film therebetween. A printing material that bears an unfixed toner image is nipped at the nip and is heated while being conveyed, and thus the toner image on the printing material is fixed to the printing material. Since the fixing apparatuses of the film heating type use a film with a heat capacity smaller than the heat capacity of fixing apparatuses of the heat roller type as a fixing member, the time taken to bring the temperature of the fixing member to a predetermined temperature (start-up time) can be reduced. The short start-up time eliminates the need to heat the fixing member during standby, reducing power consumption as much as possible.

It is known that it is important for the fixing apparatuses of the film heating type to make the gap between the upstream wall surface of the heater and the upstream end face (wall surface) of a groove hole of a holder that holds the heater small. As described in Japanese Patent No. 4599189, if a printing material is inserted into the nip, with small, hard foreign matter, such as a staple, a grain of sand, grit, or dust, attached on the surface, this configuration reduces or eliminates a phenomenon in which the foreign matter enters the gap to damage the film. In other words, decreasing the gap may reduce the force of the foreign matter entering the gap, thereby preventing the film from being punctured.

In the configuration in which the gap between the upstream wall surface of the heater and the upstream end face (wall surface) of the groove hole of the holder that holds the heater is small, the width of the gap is determined only by the width of the groove hole in the printing material conveying direction and the width of the heater. For this reason, there are cases where the gap cannot be made sufficiently small. The heater and the groove hole generally vary in width. Therefore, the width of the heater needs to be sufficiently smaller than the width of the groove hole to avoid cases where assembly is impossible. If the heater width and the groove hole width are normal, or in contrast, the heater width is small and the groove hole width varies widely, the intended small gap cannot be provided, so that sufficient resistance to foreign matter, described above, cannot be achieved.

SUMMARY OF THE DISCLOSURE

The present disclosure prevents damage to the film due to foreign matter even if the dimensional accuracy of the components of a fixing apparatus of the film heating type is low.

A fixing apparatus according to an aspect of the present disclosure includes a holding member including a groove-like holding portion, a heater supported by the holding portion, a film rotatable around the heater, the film being configured to be heated by sliding on the heater and to heat a toner image on a conveyed printing material, and a gap filling member including, on an upstream side with respect to the heater in a direction in which the circumferential surface of the film moves, a first portion disposed between the heater and the holding member and a first contact portion connecting to the first portion and being in contact with the film. A second distance between the first portion and the holding member disposed upstream from the first portion and facing the first portion is smaller than a first distance between the heater and the first portion disposed upstream from the heater and facing the holding member.

Further features and aspects of the disclosure will become apparent from the following description of example embodiments with reference to the attached drawings.

DESCRIPTION OF THE EMBODIMENTS

Example First Embodiment

First, the configuration of the main body of an image forming apparatus in the present embodiment will be described, and then, a fixing apparatus according to an embodiment of the present disclosure will be described.

Image Forming Apparatus Main Body

Figure 1:
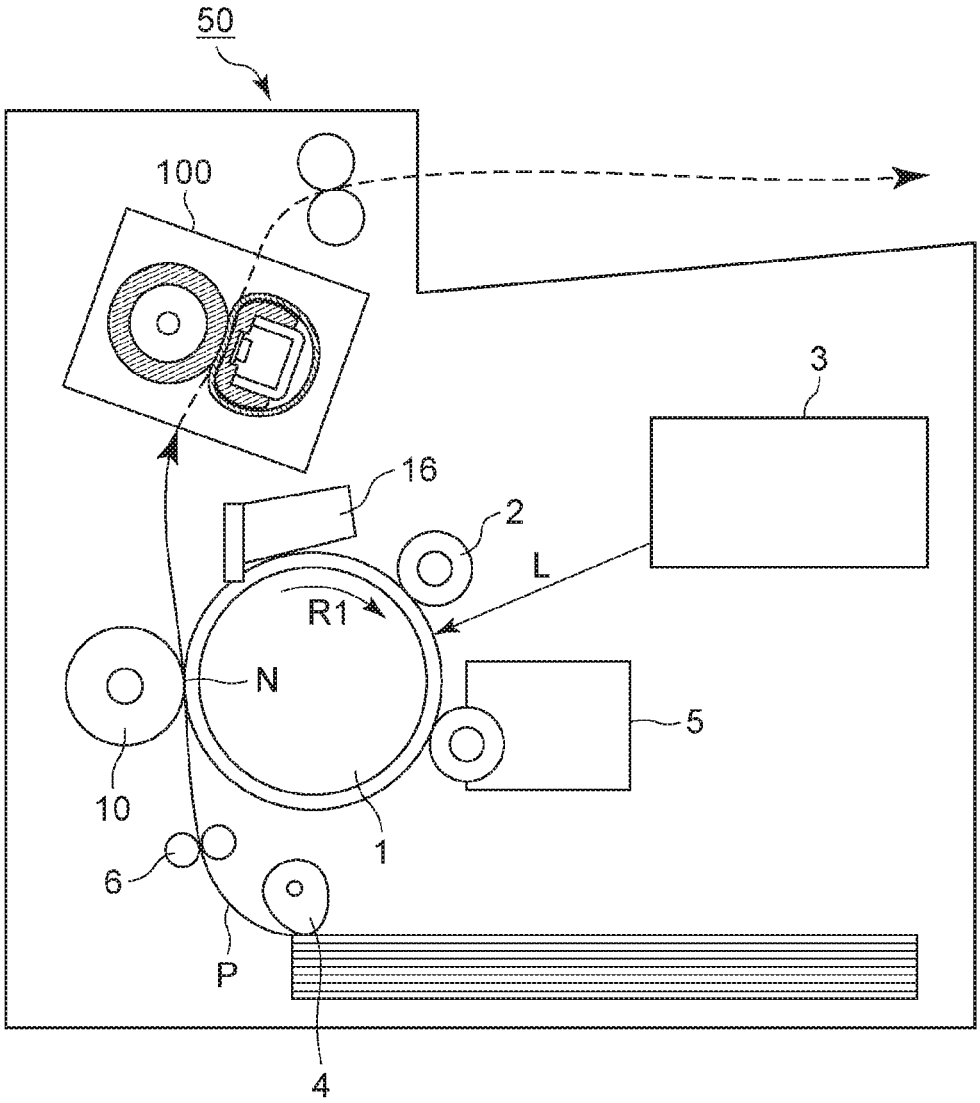
FIG. 1 is a schematic cross-sectional view of an example image forming apparatus according to an example first embodiment of the present disclosure.

In the present embodiment, an example of a method for forming an unfixed toner image on a printing material and an image forming apparatus will be described with reference to the schematic diagram illustrated in FIG. 1. An image forming apparatus 50 in the present embodiment is an electrophotographic image forming apparatus that directly transfers a toner image on a photosensitive drum 1 onto a printing material P. Around the photosensitive drum 1 serving as an image bearing member, a charging unit 2, an exposing unit 3 that applies a laser beam L to the photosensitive drum 1, a developing unit 5, a transfer roller 10, and a photosensitive-drum cleaner 16 are disposed in sequence in the rotating direction (arrow R1). First, the surface of the photosensitive drum 1 is charged to a minus polarity by the charging unit 2. Next, an electrostatic latent image is formed on the surface of the charged photosensitive drum 1 by the laser beam L from the exposing unit 3 (the surface potential of the exposed portion is increased). The toner of the present embodiment is charged to a minus polarity. The minus toner is attached only to the electrostatic latent image on the photosensitive drum 1 by the developing unit 5 that contains a black toner, so that a toner image is formed on the photosensitive drum 1. When the printing material P is fed by a sheet feeding roller 4, the printing material P is conveyed to a transfer nip N by a conveying roller 6. A transfer bias with a plus polarity opposite to the polarity of the toner is applied to the transfer roller 10 from a power source (not illustrated), so that the toner image on the photosensitive drum 1 is transferred to the printing material P at the transfer nip N. Transfer residual toner on the surface of the photosensitive drum 1 after the transfer is removed by a photosensitive-drum cleaner 16 having an elastic blade. The printing material P bearing the toner image is conveyed to a fixing apparatus 100, where the toner image on the surface is thermally fixed.

Example Fixing Apparatus

Figure 2:
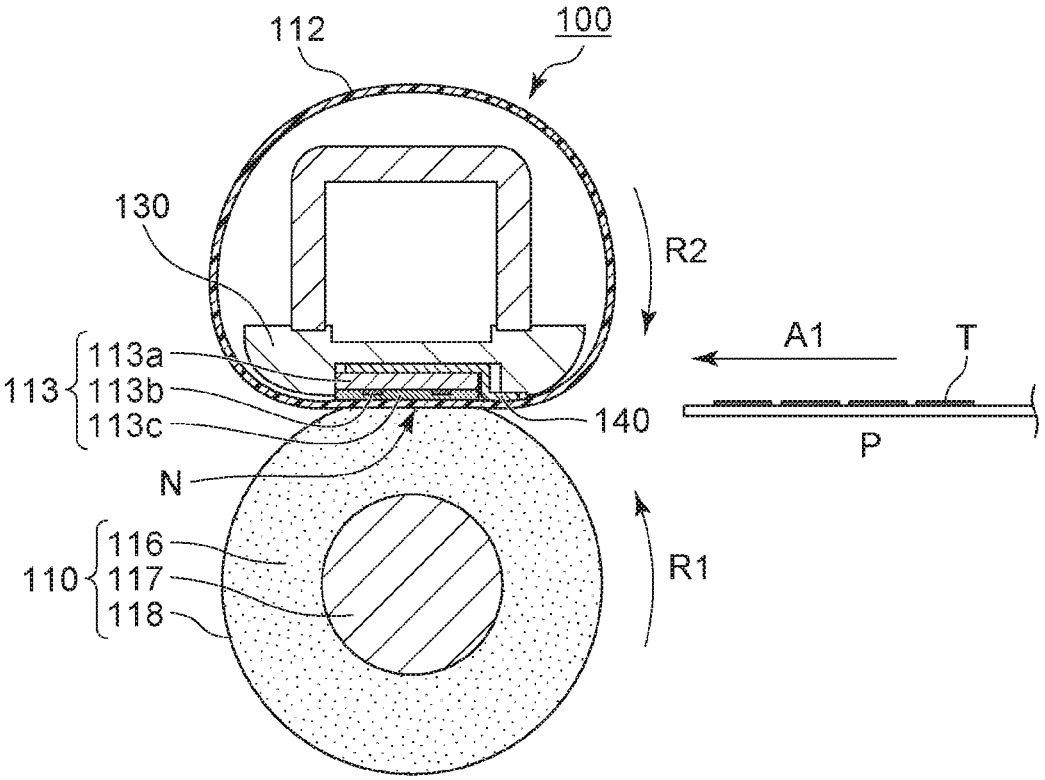
FIG. 2 is a schematic cross-sectional view of a fixing apparatus according to the example first embodiment.

Next, the fixing apparatus 100 of the present embodiment will be described. The fixing apparatus 100 of the present embodiment is of the film heating type aiming at shortening start-up time and reducing power consumption, as described above. FIG. 2 is a cross-sectional view of the fixing apparatus 100 in the present embodiment.

A gap filling member (heat transfer member) 140 is disposed on the back of a heater 113. The heat transfer member 140 and the heater 113 are held by a groove-like holding portion of a heater holder (a holding member) 130, around which a fixing film 112, which is an endless belt, is rotatably disposed. The heater 113 slides on the inner surface of the fixing film 112 to heat the fixing film 112 from the inside. A pressure roller 110 applies pressure to the heater 113 from the outside of the fixing film 112. An area at which the pressure roller 110 and the fixing film 112 are brought into contact by the pressure is a pressure nip N. When the pressure roller 110 is driven in the direction of arrow R1 in FIG. 2, the fixing film 112 receives a motive force at the pressure nip N from the pressure roller 110 to be rotated in the direction of arrow R2. When the printing material P to which an unfixed toner image T is transferred is conveyed to the pressure nip (transfer nip) N in the direction of arrow A1 in FIG. 2, the toner image T is fixed to the printing material P.

Example Fixing Film

The fixing film 112 of the present embodiment has an outside diameter of 18 mm in an undeformed cylindrical state and has a multilayer structure in the thickness direction. The layer structure of the fixing film 112 includes a base layer for maintaining the strength of the fixing film 112 and a releasing layer for reducing stain adhesion to the surface. The material of the base layer needs thermal resistance because it receives the heat from the heater 113 and also strength because the fixing film 112 slides on the heater 113, so that metal, such as stainless steel or nickel, or a heat-resistant resin, such as polyimide, may be used. In the present embodiment, a polyimide resin is used as the material of the base layer of the fixing film 112, to which a carbon-based filler is added to increase the thermal conductivity and strength. The thinner the base layer, the easier the heat of the heater 113 is transmitted to the surface of the pressure roller 110, which however decreases the strength. For that reason, the base layer preferably has a thickness of about 15 μm to 100 μm, and in the present embodiment, the base layer has a thickness of 50 μm.

The material of the releasing layer of the fixing film 112 may be a fluorocarbon polyester, such as a perfluoroalkoxy polymer (PFA), a polytetrafluoroethylene resin (PTFE), or tetrafluoroethylene-hexafluoropropylene resin (FEP). In the present embodiment, PFA having excellent releasability and heat resistance among fluorocarbon polyesters is used as the material of the releasing layer of the fixing film 112. The releasing layer may be a tube coating or a paint coating on the surface of the base layer. In the present embodiment, the releasing layer is a coating excellent in thin-wall molding. The thinner the releasing layer, the easier the heat of the heater 113 is transmitted to the surface of the fixing film 112. However, an excessively thin releasing layer decreases in durability. For this reason, the releasing layer preferably has a thickness of about 5 μm to 30 μm, and in the present embodiment, the releasing layer has a thickness of 10 μm. Although not used in the present embodiment, an elastic layer may be disposed between the base layer and the releasing layer. In this case, the material of the elastic layer is silicone rubber or fluorine-containing rubber.

Example Pressure Roller

The pressure roller 110 of the present embodiment has an outside diameter of 20 mm. The pressure roller 110 has an elastic layer 116 with a thickness of 4 mm around an iron core 117 with a diameter of 12 mm. The material of the elastic layer 116 is solid rubber or foamed rubber. The foamed rubber has a low heat capacity and low thermal conductivity, so that the heat of the surface of the pressure roller 110 is hardly absorbed inside. This offers the advantage that the surface temperature tends to rise, so that the start-up time can be reduced. In the present embodiment, foamed silicon rubber is used.

The smaller the outside diameter of the pressure roller 110, the smaller the heat capacity is. However, an excessively small outside diameter causes the width of the pressure nip to be small. For this reason, the pressure roller 110 needs a moderate diameter. In the present embodiment, the outside diameter is set to 20 mm. Also for the thickness of the elastic layer 116, an excessively small thickness causes the heat to dissipate to the metal core 117. For this reason, the elastic layer 116 needs an appropriate thickness. In the present embodiment, the thickness of the elastic layer 116 is set to 4 mm. A toner releasing layer 118 made of a perfluoroalkoxy polymer (PFA) is formed on the elastic layer 116. The releasing layer 118 may be a tube coating or a paint coating on the surface of the elastic layer 116, like the releasing layer of the fixing film 112. In the present embodiment, the releasing layer 118 is a tube having high durability. In addition to PFA, the material of the releasing layer 118 may be fluorocarbon polyester such as PTFE or FEP, or fluorine-containing rubber or silicone rubber having high releasability.

The lower the surface hardness of the pressure roller 110, the larger width of the pressure nip N is obtained at low pressure. In the present embodiment, the pressure roller 110 with an Asker-C hardness (a load of 4.9N) of 50 degrees is used. The pressure roller 110 is pressed to the heater 113 by a pressure unit (not illustrated). The total pressing force is set to 15 kg.

The pressure roller 110 is rotated by a rotating unit (not illustrated) in the direction of arrow R1 in FIG. 2 at a surface moving speed of 200 mm/sec.

Example Heater

The heater 113 of the present embodiment is a common heater for use in a fixing apparatus of the film heating type and has a resistive heating element 113*b* on a ceramic substrate 113*a*. Specifically, the resistive heating element 113*b* is formed by applying 10-μm silver palladium (Ag/Pd) onto the surface of the alumina substrate 113*a* with a width of 7 mm and a thickness of 1 mm by screen printing in the conveying direction of the printing material P, that is, a direction in which the circumferential surface of the film 112 moves. A heating-element protective layer 113*c* is formed from glass with a thickness of 50 μm on the substrate 113*a* so as to cover the heater 113. The temperature of the heater 113 is regulated by appropriately controlling a current that is to be made flow to the resistive heating element 113*b* according to the signal of a temperature sensor (not illustrated) for detecting the temperature of the ceramic substrate 113*a* or the film 112.

Example Gap Filling Member

Figure 3:
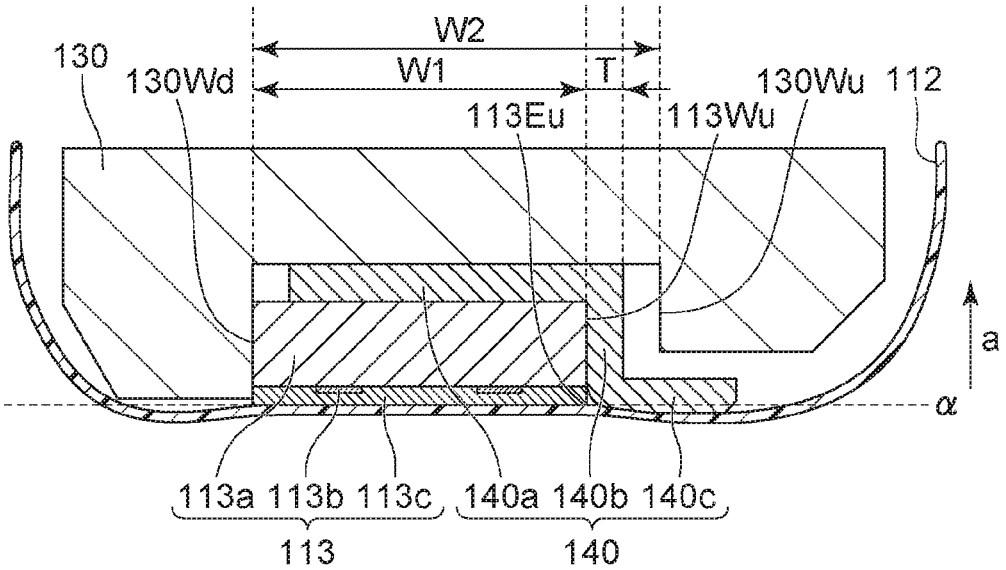
FIG. 3 is a schematic cross-sectional view of part of the fixing apparatus according to the example first embodiment.

The gap filling member 140, which is a feature of the present embodiment, will be described with reference to FIG. 3 which is a schematic cross-sectional view of part of the fixing apparatus 100. The gap filling member 140 includes a sandwiched portion (a second portion) 140*a*, a restricting portion (a first portion) 140*b*, and a sliding portion (a first contact portion) 140*c* in this order from a side downstream from the heater 113. The sandwiched portion 140*a* is disposed on a surface of the heater 113 opposite to the sliding surface and can be sandwiched between the heater 113 and the heater holder 130 by the pressing force from the pressure roller 110. The restricting portion 140*b* connects to the sandwiched portion 140*a* at one end upstream from the heater 113, is positioned between the heater 113 and the heater holder 130, and extends along the substrate 113*a* of the heater 113 toward the resistive heating element 113*b* and the heating-element protective layer 113*c*. The restricting portion 140*b* is configured to restrict the movement of the gap filling member 140 by contacting with an upstream wall surface 113Wu of the heater 113. The sliding portion 140*c* extends from the other end of the restricting portion 140*b* into contact with the film 112 to receive a frictional force due to the rotation of the film 112. The length of the sandwiched portion 140*a* in the conveying direction is made smaller than the minimum width W1 of the heater 113 in the conveying direction that takes when varying at the manufacturing. This is for the purpose of bringing the restricting portion 140*b* and one end of the sliding portion 140*c* into close-contact with the upstream wall surface 113Wu of the heater 113 without coming into contact with a downstream wall 130Wd of the heater holder 130 in the conveying direction when the gap filling member 140 is slid downstream in the conveying direction. In order to bring the restricting portion 140*b* into close-contact with the heater 113, the gap filling member 140 may be pressed against the heater 113 manually or with a dedicated jig. In the case of using a dedicated jig, after the heater holder 130, the gap filling member 140, the heater 113, and the film 112 are combined, the gap filling member 140 is kept slid downstream in the conveying direction with the jog until they are pressed by the pressure roller 110. This prevents foreign matter from entering the pressure nip N immediately after the assembly and before the gap between the heater 113 and the gap filling member 140 is filled. In operation, the surface of the sliding portion 140*c* receives friction, so that the gap filling member 140 is constantly slid in the direction in which the restricting portion 140*b* comes into close-contact with the upstream wall surface 113Wu of the heater 113. Thus, the restricting portion 140*b* and the upstream wall surface 113Wu of the heater 113 are kept in close contact even in operation.

Example Amount of Protrusion

The sliding portion 140*c* is disposed so as to protrude on the upstream side of the heater 113 toward the pressure roller 110, that is, toward the film 112, with respect to a plane a of the heater 113 (the heating-element protective layer 113*c*) extending in a direction perpendicular to the pressing direction a of the pressure roller 110. This allows receiving the friction from the film 112 with the sliding portion 140*c*. This also prevents a corner 113Eu between the upstream wall surface 113Wu of the heater 113 and a surface (a slide surface) of the heater 113 (the heating-element protective layer 113*c*) adjacent to the film 112 from coming into contact with the film 112 if foreign matter intrudes between the film 112 and the pressure roller 110. The corner 113Eu of the heater 113 is very sharp. For this reason, when foreign matter intrudes between the film 112 and the pressure roller 110, the inner surface of the film 112 urged by the foreign matter can come into strong-contact with the corner 113Eu of the heater 113 to damage the film 112. In the present embodiment, the amount of protrusion of the sliding portion 140*c* protruding toward the pressure roller 110 with respect to the plane a of the heater 113 extending in the direction perpendicular to the pressing direction a is set at 0.1 mm or more to prevent the corner 113Eu of the heater 113 from coming into strong-contact with the inner surface of the film 112.

Example Variations in Dimensions of Parts

Variations in dimensions of parts in the present embodiment are the width W1 of the heater 113 in the conveying direction, the width W2 of the groove of the heater holder 130 (the holding portion) in the conveying direction, and the thickness T of the restricting portion 140*b*. Variations in the width W1 of the heater 113 and the width W2 of the groove of the heater holder 130 are ±0.5 mm. The thickness T of the gap filling member 140 indicated in the drawing, that is, the nominal dimension, is 0.3 mm, and its variations are ±0.1 mm. The heater width W1 and the width W2 of the groove of the heater holder 130 are relatively large in the original dimensions, and the heater 113 and the gap filling member 140 need to be sufficiently long also in the sheet width direction. Therefore, variations in dimensions of the heater 113 and the gap filling member 140 are larger than the variation in the thickness T of the restricting portion 140*b* in view of variations in dimensions of the parts across the sheet width. Variations in the thickness T of the restricting portion 140*b* can be reduced by forming the gap filling member 140, for example, by bending a thin plate, although this depends on the manufacturing method. The gap is minimized when the heater 113 can be combined with the heater holder 130 so as to be fitted in the heater holder 130. In this case, to enable the heater 113 to be combined with the heater holder 130, the dimension obtained by adding the thickness T of the restricting portion 140*b* to the heater width W1 needs to be smaller than the width W2 of the groove of the heater holder 130 by 0.1 mm. In other words, conditions for assembly in the present embodiment include that the heater width W1 is 7.5 mm, which is the largest size that can be taken due to variations, that the thickness T of the restricting portion 140*b* is 0.4 mm, which is the largest size that can be taken due to variations, and that the width W2 of the groove of the heater holder 130 is 8.0 mm or more. For this reason, the nominal dimension of the width W2 of the groove of the heater holder 130 needs to be 8.5 mm, which is larger than the smallest width W2 of the groove of the heater holder 130 by 0.5 mm, which is the variation of the heater holder 130.

Dimensions of Comparative Example

Figure 4:
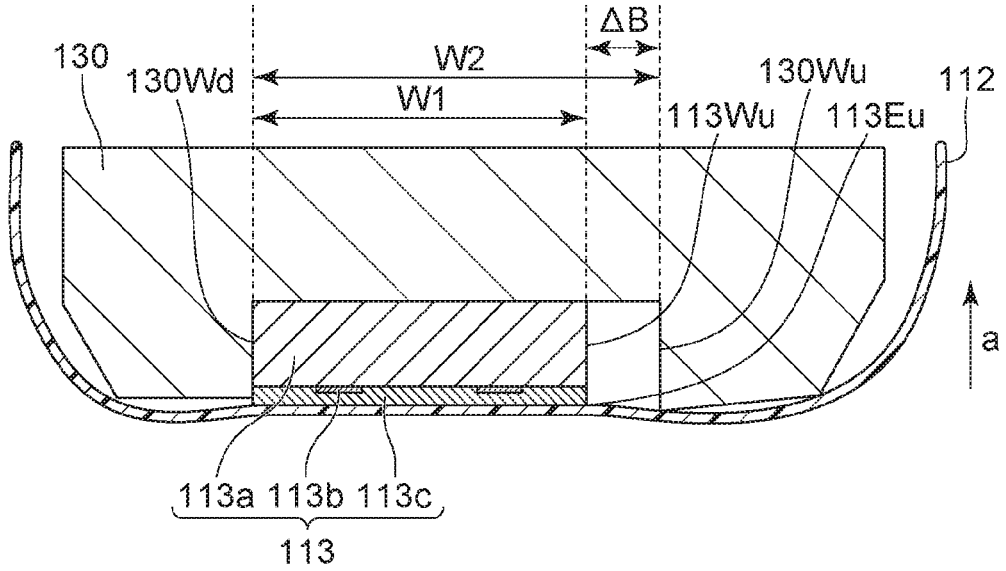
FIG. 4 is a schematic cross-sectional view of part of a fixing apparatus according to a comparative example.

In the present embodiment, a configuration in which the gap filling member 140 is not disposed is produced as a comparative example for evaluation, as illustrated in the schematic diagram of FIG. 4. A condition for enabling assembly in the comparative example is that the width W2 of the groove of the heater holder 130 is 7.6 mm or more at the minimum when the heater width W1 is 7.5 mm. Therefore, the width W2 of the groove of the heater holder 130 is 8.1 mm in nominal dimension.

Method of Evaluation

Figure 5A:
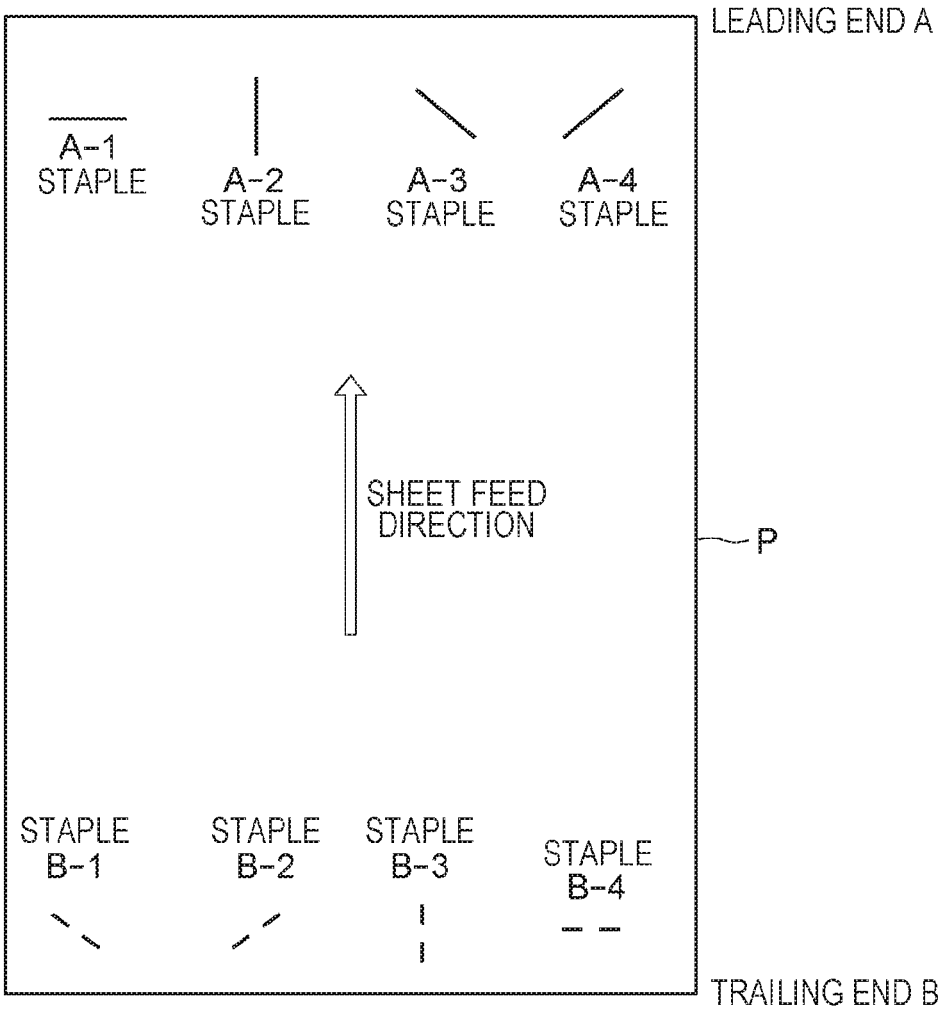
FIG. 5A is a schematic diagram of a test printing material.
Figure 5B:
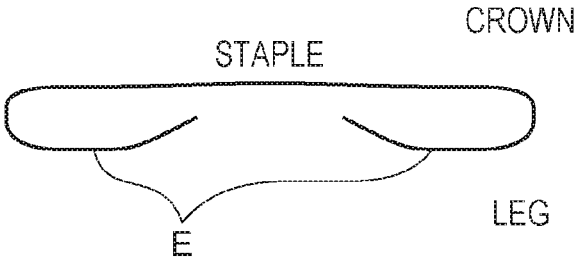
FIG. 5B is a schematic diagram of a staple

A test printing material P to be used in comparative examination will be described with reference to FIG. 5A which is a schematic diagram of the test printing material P and FIG. 5B which is a schematic diagram of a staple. The printing material P is intentionally provided with staples (foreign matter) in the vicinity A of the leading end of the printing material P and the vicinity B of the trailing end. Each staple has legs on both ends of the crown. The crown is urged by a stapler, so that the legs pass through the printing material P. Thereafter, the crown is further urged, so that the legs are bent toward the crown so that the staple is fixed to the printing material P so as to sandwich the printing material P with the crown and the legs.

A group A of staples A-1, A-2, A-3, and A-4 are stapled at the leading end of the printing material P. The staple A-1 is fixed to the printing material P in such a manner that the crown is located in a direction perpendicular to the sheet feeding direction. The crown (the back) of the staple A-1 is placed on the pressure roller 110 side (see FIG. 5B). The staple A-2 is fixed to the printing material P such that the crown is parallel to the sheet feeding direction. The crown of the staple A-2 is placed on the pressure roller 110 side. The staple A-3 is fixed to the printing material P such that the crown is rotated 45 degrees counterclockwise with respect to the sheet feeding direction so that the staple A-3 forms an angle of 45 degrees with the sheet feeding direction. The crown of the staple A-3 is placed on the pressure roller 110 side. The staple A-4 is fixed to the printing material P such that the crown is rotated 45 degrees clockwise with respect to the sheet feeding direction so that the staple A-4 forms an angle of 45 degrees with the sheet feeding direction. The crown of the staple A-3 is placed on the pressure roller 110 side.

Next, a group B of staples B-1, B-2, B-3, and B-4 are stapled at the trailing end of the printing material P. The staple B-1 is fixed to the printing material P such that the crown is rotated 45 degrees counterclockwise with respect to the sheet feeding direction so that the staple B-1 forms an angle of 45 degrees with the sheet feeding direction. The crown (the back) of the staple B-1 is placed on the film 112 side. The staple B-2 is fixed to the printing material P such that the crown is rotated 45 degrees clockwise with respect to the sheet feeding direction so that the staple B-2 forms an angle of 45 degrees with the sheet feeding direction. The crown of the staple B-2 is placed on the film 112 side. The staple B-3 is fixed to the printing material P such that the crown is parallel to the sheet feeding direction. The crown of the staple B-3 is placed on the film 112 side. The staple B-4 is fixed to the printing material P such that the crown is located in the direction perpendicular to the sheet feeding direction. The crown of the staple B-4 is placed on the film 112 side Every time 100 printing materials P in this state have been passed, one high-definition print image is printed, and the state of the film 112 is checked. The high-definition print image in this testing is a 1-dot/2-space stripe image output from an image forming apparatus with a resolution of 600 dpi. If an abnormality occurs in the film 112, a poor fixation point occurs at the abnormal film position to cause an image defect. After the testing, the fixing apparatus is disassembled to check the state of the film 112. This evaluation shows that when the gap in the conveying direction upstream from the upstream wall surface 113Wu of the heater 113 is 0.5 mm or more in width, the staple intrudes into the gap to damage the film 112.

Evaluation Results

For comparative examination, the configuration of nominal dimensions, a configuration in which the gap is largest, and a configuration in which the gap is smallest are prepared for each of the present embodiment and the comparative example.

TABLE 1

Dimensional relationship among configurations in first embodiment (mm) and results of foreign matter testing

| | Heater width W1 | Thickness of gap filling member T | Groove width of heater holder W2 | ΔB | ΔA | Result of foreign matter testing |
|---|---|---|---|---|---|---|
| Nominal dimension | 7 | 0.3 | 8.5 | 0 | 1.2 | Good |
| Gap smallest | 7.5 | 0.4 | 8.0 | 0 | 0.1 | Good |
| Gap largest | 6.5 | 0.2 | 9.0 | 0 | 2.3 | Good |

Table 1 illustrates the dimensional relationship among the configurations and the evaluation results in the present embodiment. In the present embodiment, the gap AB was smallest when the heater width W1 and the thickness T of the restricting portion 140*b* are largest and the groove width W2 of the heater holder 130 is smallest. In this case, the width of the gap ΔB (a second width) between the restricting portion 140*b* and the upstream wall surface 113Wu of the heater 113 immediately after the heater 113 is embedded in the heater holder 130 and the gap filling member 140 can take 0.1 mm at the maximum. The gap ΔB was largest in the present embodiment when the heater width W1 and the thickness T of the restricting portion 140*b* are smallest and the groove width W2 of the heater holder 130 is largest. In this case, the width of the gap ΔB immediately after the heater 113 is embedded in the heater holder 130 and the gap filling member 140 can take 2.3 mm at the maximum. Even in such cases, by combining the gap filling member 140 while being slid downstream as in FIG. 3, the gap ΔB takes 0 mm immediately after the assembly. This also applies to the other dimensional relationships. Thus, with the configuration of the present embodiment, the gap ΔB during operation was 0 mm in the configurations of all the dimensional relationships, so that no foreign matter intrudes into the gap ΔB upstream from the heater 113. Therefore, the film 112 was not damaged, causing no image defect after the foreign matter testing. In all of the examples, the gap ΔB was smaller than the gap ΔA (a first width) between the restricting portion 140*b* and an upstream wall surface 130Wu of the heater holder 130.

TABLE 2

Dimensional relationship among configurations in comparative example (mm) and results of foreign matter testing

| | Heater width W1 | Groove width of heater holder W2 | ΔB | Result of foreign matter testing |
|---|---|---|---|---|
| Nominal dimension | 7 | 8.1 | 1.1 | Poor |
| Gap smallest | 7.5 | 7.6 | 0.1 | Good |
| Gap largest | 6.5 | 8.6 | 2.1 | Poor |

Next, the dimensional relationship among the configurations and the evaluation results in the comparative example will be described with reference to Table 2. In the comparative example, the gap ΔB was smallest when the heater width W1 is largest and the groove width W2 of the heater holder 130 is smallest. In this case, the width of the gap ΔB between the wall surface 130Wu of the heater holder 130 and the upstream wall surface 113Wu of the heater 113 was 0.1 mm, as described above. The gap ΔB was largest when the heater width W1 is smallest and the groove width W2 of the heater holder 130 is largest. In the configuration of the comparative example, the gap ΔB was 0.1 mm in the configuration of the smallest gap, which falls below 0.5 mm, so that no image defect occurred after the foreign matter testing. However, in the configuration of the nominal dimensions and the configuration of the largest gap, the gap ΔB was respectively 1.1 mm and 2.1 mm, which exceed 0.5 mm, so that an image defect occurred after the foreign matter testing, and the film 112 was punctured.

This shows that setting the gap ΔB (the second width) between the restricting portion 140*b* and the upstream wall surface 113Wu of the heater 113 smaller than the gap ΔA (the first width) between the restricting portion 140*b* and the upstream wall surface 130Wu of the heater holder 130 reduces or eliminates an image defect after foreign matter testing. This also shows that it is preferable to set, in particular, the gap ΔB to 0.5 mm or less. This reduces or eliminates an image defect after foreign matter testing, and prevents the film 112 from being punctured.

Example Modification of Gap Filling Member

Figure 6A:
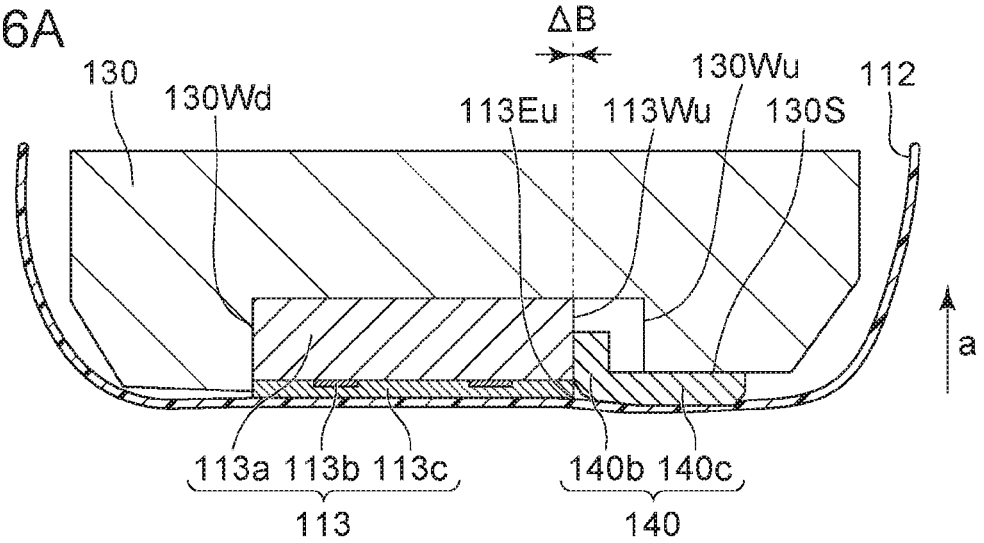
FIGS. 6A to 6C are schematic cross-sectional views of part of fixing apparatuses according to modifications of the example first embodiment.

In the present embodiment, the length of the restricting portion 140*b* that fills the gap in the pressing direction a of the pressure roller 110 is sufficiently larger than the thickness of the heater 113 so that the sliding portion 140*c* is disposed adjacent to the pressure roller 110 with respect to the plane α. Alternatively, the sandwiched portion 140*a* may not be disposed between the heater 113 and the heater holder 130, as in FIG. 6A. In other words, the absence of the sandwiched portion 140*a* sandwiched between the heater 113 and the heater holder 130 reduces reaction to the sliding force received from the film 112 through the sliding portion 140*c*, allowing the gap filling member 140 to slide on the heater holder 130. With this configuration, the sliding portion 140*c* is backed with a support surface 130S of the heater holder 130 from the opposite side of the pressure roller 110. This configuration causes the gap filling member 140 to automatically slide downstream in the conveying direction as the film 112 rotates, thereby decreasing the gap ΔB. This has the advantage that there is no need to perform a special work or use a dedicated jib for assembly. In other words, since the gap filling member 140 is slidable with respect to the heater holder 130, even if the gap ΔB between the restricting portion 140*b* and the upstream wall surface 113Wu of the heater 113 is large, the gap ΔB can be brought to 0 mm by the time the printing material P reaches the fixing apparatus 100. However, in order to reliably slide the gap filling member 140 downstream, it is necessary to apply grease to the entire surface of the support surface 130S.

Figure 6B:
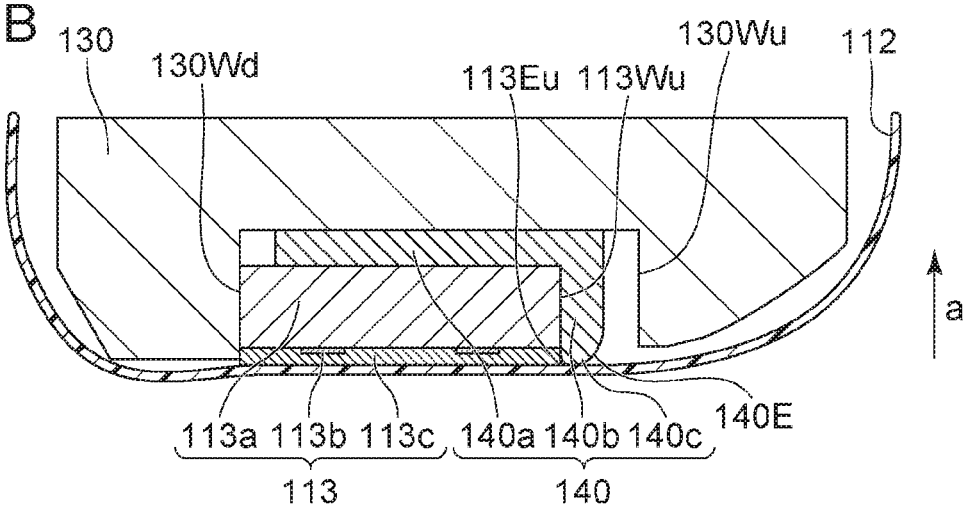
Figure 6C:
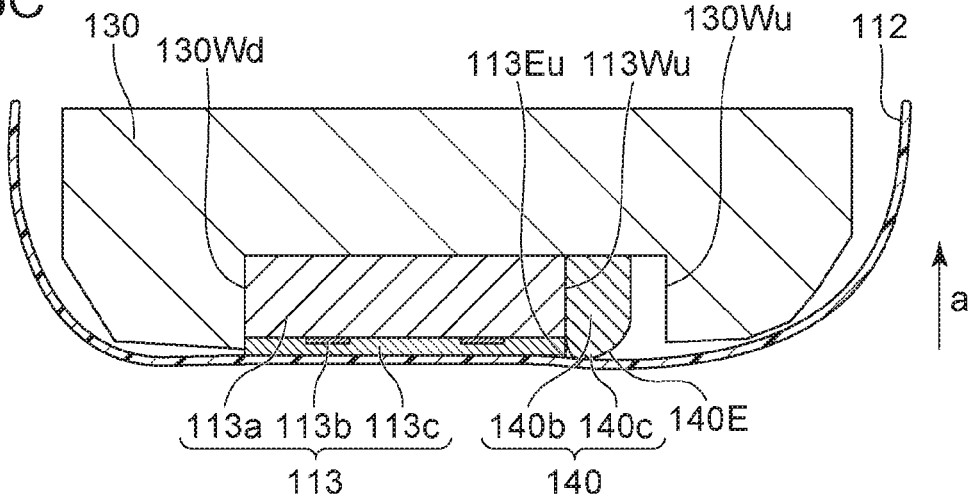

The sliding portion 140*c* may not cover the gap between the upstream wall surface 130Wu of the heater holder 130 and the restricting portion 140*b*, as illustrated in FIG. 6B and FIG. 6C. In other words, an end of the restricting portion 140*b* adjacent to the film 112 may serve as the sliding portion 140*c*. However, in this case, the sliding portion 140*c* needs to protrude from the heater 113 toward the film 112, and an upstream corner 140E of the sliding portion 140*c* needs to be sufficiently smooth. Even if the inner surface of the film 112 faces the gap between the upstream wall surface 130Wu of the heater holder 130 and the restricting portion 140*b*, if the upstream corner 140E of the sliding portion 140*c* is not sharp but smooth, the film 112 will not be damaged. Compared with the configurations in FIG. 3 and FIG. 6A, such a configuration has the advantage that the manufacturing cost is low because the shape of the gap filling member 140 is simple.

Figure 7A:
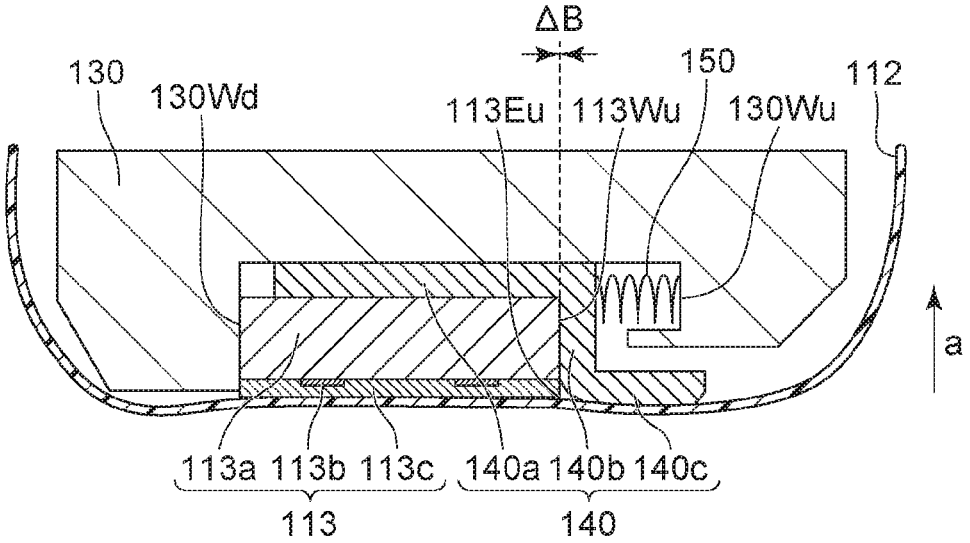
FIGS. 7A and 7B are schematic cross-sectional views of part of fixing apparatuses according to modifications of the example first embodiment.

As illustrated in FIG. 7A, the gap filling member 140 may be slidable with respect to the heater holder 130, and an elastic urging member 150, such as a spring, may be added to push the gap filling member 140 against the heater 113. In the modification, the urging member 150 is disposed between the gap filling member 140 and the upstream wall surface 130Wu of the heater holder 130. This may provide the same advantageous effect without applying grease between the heater holder 130 and the gap filling member 140 or without performing a special work or using a dedicated jig in attaching the gap filling member 140. However, such a configuration needs to add the urging member 150. Also in this case, the same advantageous effect is provided regardless of the presence of the sandwiched portion 140*a*.

Figure 7B:
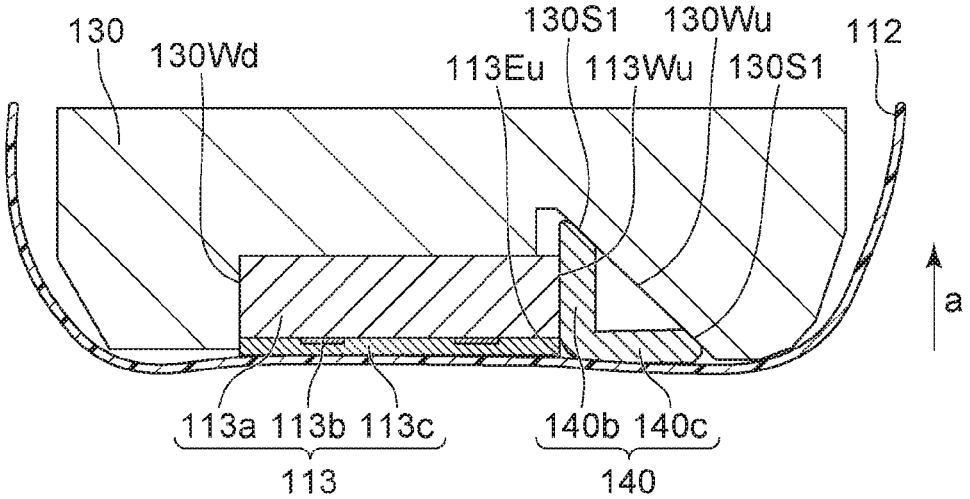

As illustrated in FIG. 7B, the upstream wall surface 130Wu of the heater holder 130 is inclined from the upstream side to the downstream side in the conveying direction with an increasing distance from the pressure roller 110. The wall surface 130Wu has supporting portions 130S1 and 130S2 for the gap filling member 140, and the gap filling member 140 is slidable on the heater holder 130. Thus, the gap filling member 140 may be enabled to move along the wall surface 130Wu by the components of the pressing force applied from the pressure roller 110 to be pushed against the heater 113. In this modification, the gap filling member 140 is automatically slid downstream in the conveying direction to decrease the gap ΔB. This therefore has the advantage that there is no need to apply grease between the heater holder 130 and the gap filling member 140, perform a special work, or use a dedicated jog during assembly. In this case, the gap filling member 140 including the restricting portion 140*b* and the sliding portion 140*c* and not including the sandwiched portion 140*a* is used.

The material of the gap filling member 140 may be a heat resistant resin, metal, or ceramic with sufficient strength not to be broken when foreign matter intrudes. The present embodiment employs aluminum.

Example Second Embodiment

A second embodiment of the present disclosure will be described hereinbelow. Since a fixing apparatus according to the second embodiment differs only in the shape of the gap filling member 140 and the shape of the heater holder 130, and the other configurations are the same as those of the first embodiment, the detailed description of the main body will be omitted.

Figure 8A:
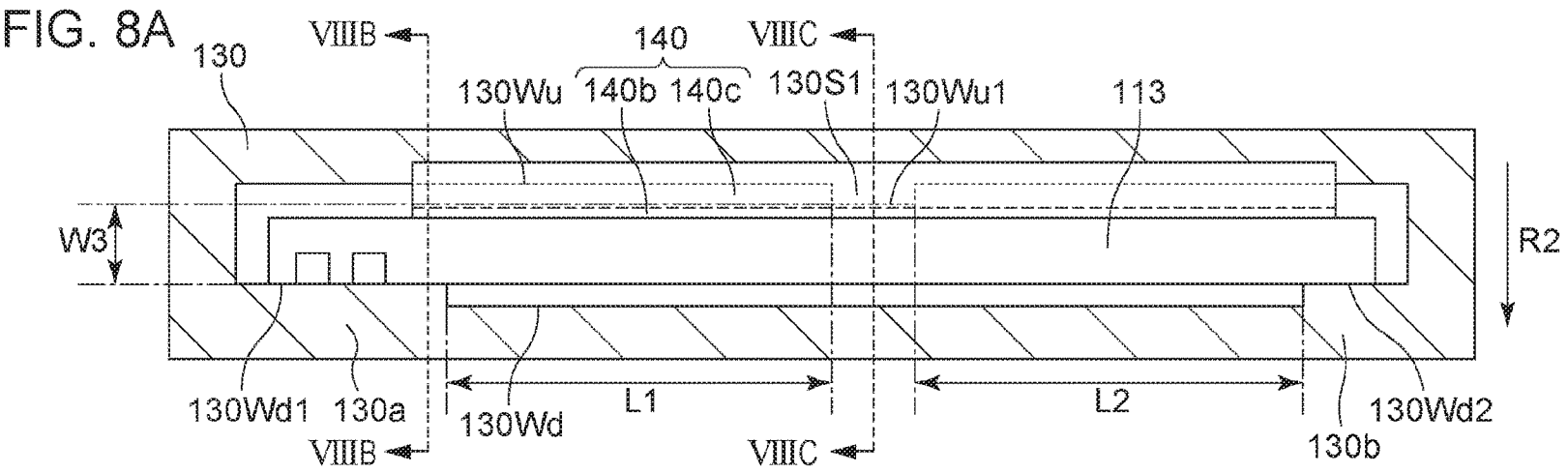
FIG. 8A is a schematic cross-sectional view of part of a fixing apparatus according to an example second embodiment of the present disclosure.

Referring to FIG. 8A, a configuration for positioning the heater 113 and the gap filling member 140 upstream and downstream in the conveying direction of the printing material P with the heater holder 130, which is a feature of the present disclosure, will be described. FIG. 8A is a schematic diagram of the heater holder 130, the heater 113, and the gap filling member 140 viewed from the pressure roller 110. The conveying direction is the direction of arrow R2. The heater holder 130 includes positioning portions 130*a* and 130*b* at both longitudinal ends to restrict the downstream movement of the heater 113. The heater holder 130 also has a supporting portion 130S at the longitudinal center and restricts the upstream movement of the gap filling member 140. Since the supporting portion 130S1 and the restricting portion 140*b* overlap with the sliding portion 140*c* of the gap filling member 140 and are hidden, the outline of the heater holder 130 including the supporting portion 130S1 is indicated by a dotted line, and the outline of the restricting portion 140*b* (a bend line with respect to the sliding portion 140*c*) is indicated by a broken line.

Figure 8B:
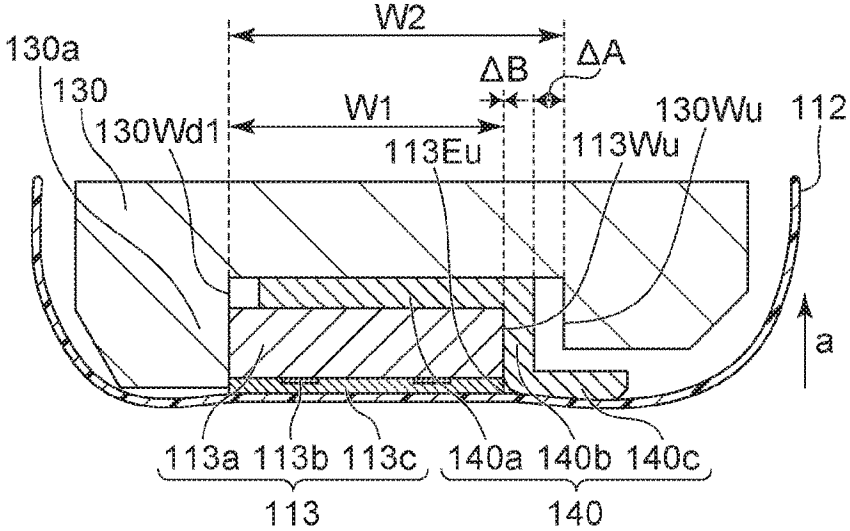
FIGS. 8B and 8C are schematic diagrams of the fixing apparatus in FIG. 8A viewed from a pressure roller.

FIG. 8B is a schematic diagram of a cross section VIIIB including the positioning portion 130*a* in FIG. 8A. Since the supporting portion 130S1 restricts the upstream side, the downstream wall surface of the heater 113 is close to a wall surface 130Wd1 of the positioning portion 130*a*. In contrast, the gap ΔA between the upstream wall surface 130Wu of the heater holder 130 and the restricting portion 140*b* of the gap filling member 140 has a certain width. This is achieved by providing a sufficiently large groove width W2 between the wall surface 130Wd1 and the wall surface 130Wu. The large gap ΔA has the effect of absorbing variations in the heater width W1 and the groove width W2. Actual dimensional relationship will be described later.

Figure 8C:
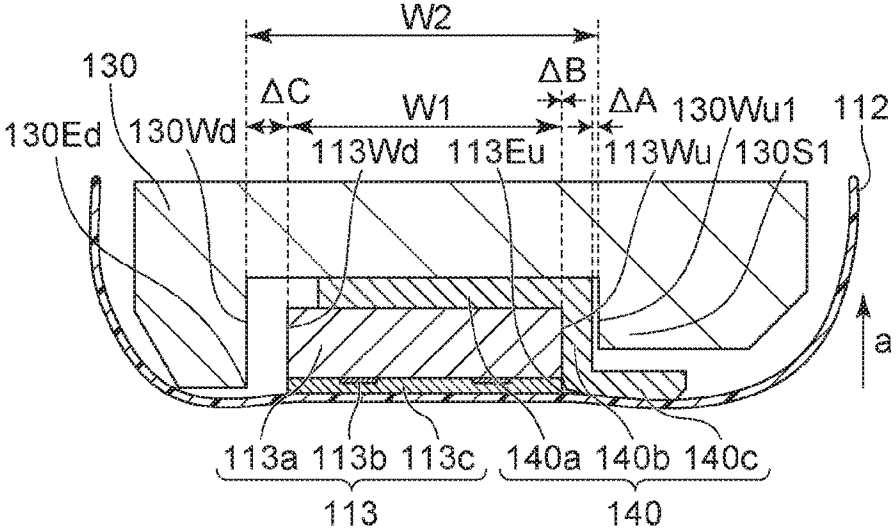

FIG. 8C is a schematic diagram of a cross section VIIIC including the supporting portion 130S1 in FIG. 8A. A wall surface 130Wu1 of the supporting portion 130S1 is positioned close to the restricting portion 140*b* to restrict the upstream movement of the restricting portion 140*b*. Let ΔC be the gap between a downstream wall surface 113Wd of the heater 113 and a downstream wall surface 130Wd1 of the heater holder 130. Since the gap ΔC is large, variations in the heater width W1 and the groove width W2 can be absorbed. A corner 130Ed of the downstream wall surface 130Wd of the heater holder 130 is made a sufficiently smooth shape or made of a soft material that may not damage the film 112 (a resin lower in strength than the film 112). This prevents the corner 130Ed from damaging the film 112.

Referring again to FIG. 8A, the relationship between the positioning portion 130*a* and the supporting portion 130S1 will be described. Assume that the distance in the conveying direction between the wall surface 130Wu1 of the supporting portion 130S1 and the respective wall surfaces 130Wd1 and 130Wd2 of the positioning portions 130*a* and 130*b* is a positioning distance W3. Assume that the lengths of portions of the wall surface 130Wu1 and the wall surfaces 130Wd1, in the longitudinal direction of the heater 113, which are most close to each other, are L1 and L2, respectively. The smaller the positioning distance W3, the heater 113 and the gap filling member 140 are brought into closer-contact with each other, which is advantageous in preventing intrusion of foreign matter. However, if the positioning distance W3 is small, the positioning distance W3 can be smaller than the width obtained by adding the heater width W and the thickness T of the gap filling member 140 to cause a situation in which the heater 113 and the gap filling member 140 cannot be attached to the heater holder 130. However, in this configuration, the wall surfaces 130Wd1 and 130Wd2 respectively have sufficient lengths L1 and L2 with respect to the wall surface 130Wu1 so that the heater 113 and the gap filling member 140 can be bent. This may prevent the heater 113 and the gap filling member 140 from being unable to be attached to the heater holder 130 even if the component accuracy is low.

Actual dimensional relationship and evaluation results will be described with reference to Table 3. Variations in dimensions of parts were 7±0.5 mm for the heater width W1, 0.3±0.1 mm for the thickness T of the restricting portion 140*b*, as in the first embodiment, and ±0.5 mm for the positioning distance W3. In the present embodiment, variations in dimensions of parts at which the gap ΔB between the upstream wall surface 113Wu of the heater 113 and the restricting portion 140*b* was largest when the positioning distance W3 is large, the width W1 of the heater 113 is small, and the thickness T of the gap filling member 140 is small. Also in this case, the positioning distance W3 was set to 7.1 mm at the maximum to make the gap ΔB 0.4 or less. The gap relationship in the configuration of nominal dimensions and the configuration of the smallest gap is illustrated in Table 3. In any configuration, the gap ΔB was 0.4 mm or less, which cleared the foreign matter testing. The deflection amount β of the heater 113 at the longitudinal center of the gap filling member 140 (at a point equally distant from the positioning portions 130*a* and 130*b*) was the largest 1.8 mm when the gap ΔB is smallest.

TABLE 3

| | Heater width W1 | Thickness of gap filling member T | positioning distance W3 | Deflection amount of heater β | Maximum ΔB | Result of foreign matter testing |
|---|---|---|---|---|---|---|
| Nominal dimension | 7 | 0.3 | 6.6 | 0.7 | 0 | Good |
| Gap smallest | 7.5 | 0.4 | 6.1 | 1.8 | 0 | Good |
| Gap largest | 6.5 | 0.2 | 7.1 | 0 | 0.4 | Good |

Figure 9:
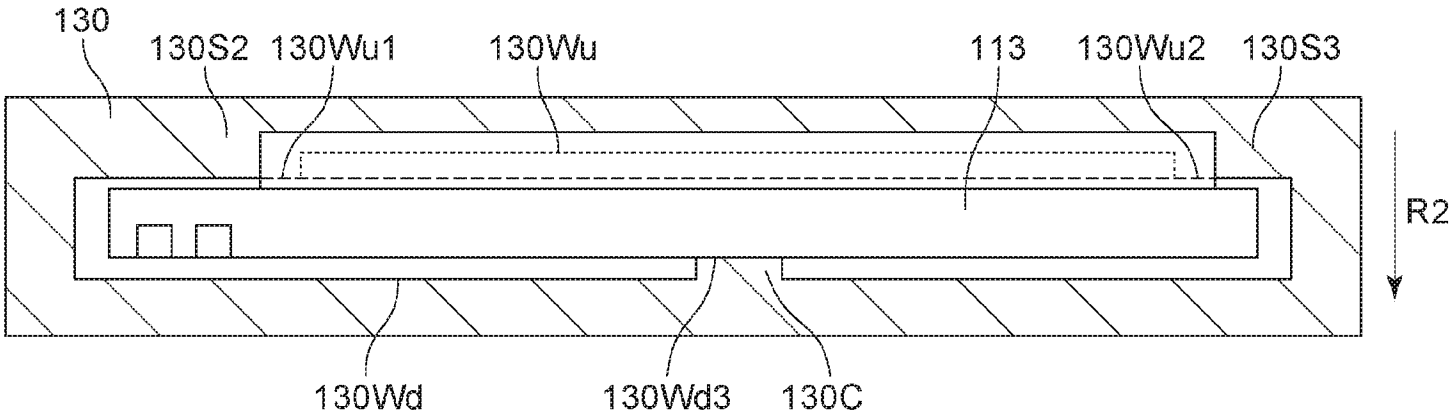
FIG. 9 is a schematic diagram of part of a fixing apparatus according to a modification of the example second embodiment viewed from the pressure roller.

In the present embodiment, the positioning portions 130*a* and 130*b* are disposed at both ends, and the supporting portion 130S1 is disposed at the center. Alternatively, the positioning portion 130*c* for restricting the movement of the heater 113 may be disposed at the center, and the supporting portions 130S2 and 130S3 for restricting the movement of the gap filling member 140 may be disposed at both ends, as illustrated in FIG. 9.

In the present embodiment, in the case where the positioning portions 130*a* and 130*b* are disposed at both ends, the cross section VIIIB including the positioning portion 130*a* includes the gap filling member 140. However, the gap filling member 140 may be decreased in longitudinal width so that the cross section VIIIC including the supporting portion 130S1 does not include the gap filling member 140. This configuration reduces the amount of the material of the gap filling member 140.

As described above, the gap relationship between the upstream positioning portion and the downstream positioning portion differs depending on the cross section in the longitudinal position. Thus, even if the component accuracy is low, resistance to foreign matter can be satisfied without decreasing the assembly performance at low cost, without the need for providing an additional component, applying grease between the heater holder 130 and the gap filling member 140, performing a special work, or using a dedicated jig.

Example Third Embodiment

Figure 10A:
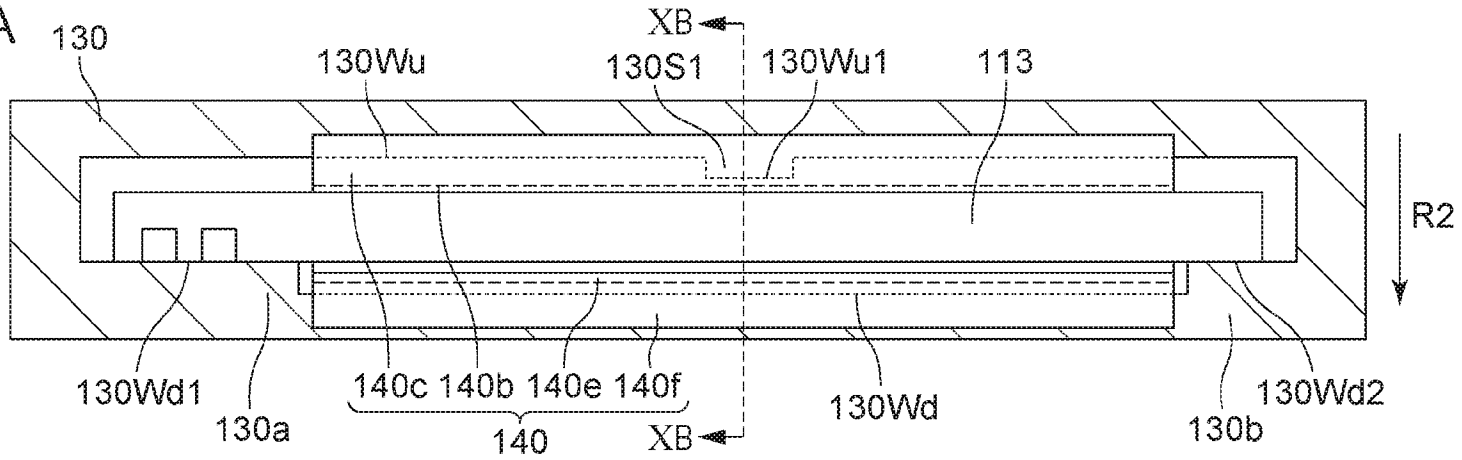
FIG. 10A is a schematic cross-sectional view of part of a fixing apparatus according to an example third embodiment of the present disclosure.
Figure 10B:
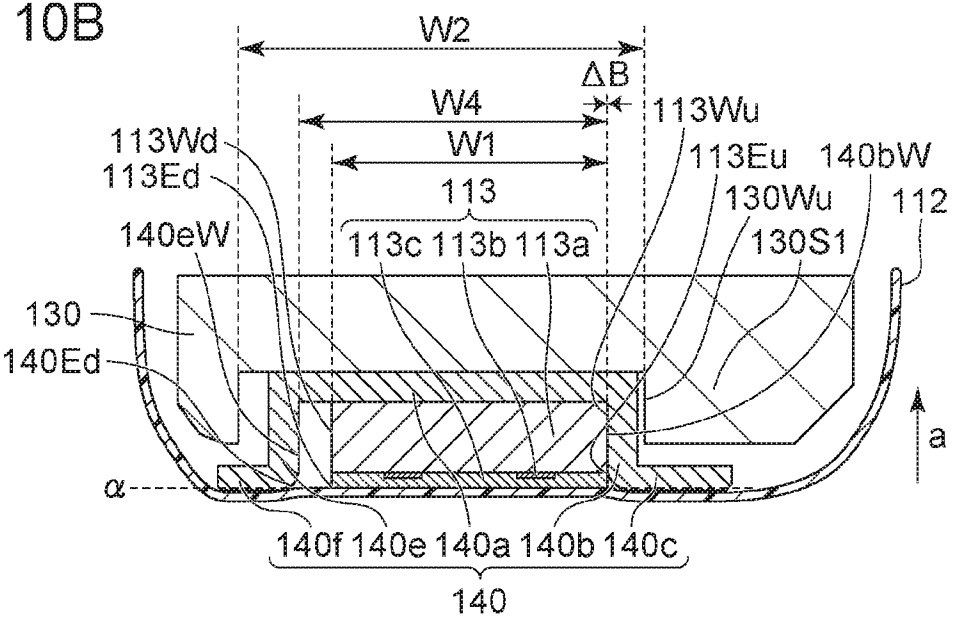
FIG. 10B is a cross-sectional view of the fixing apparatus in FIG. 10A viewed from the pressure roller.

The first and second embodiments illustrate a configuration in which the gap filling member 140 has the sliding portion 140*c* only on the upstream side, but the sliding portion 140*c* may also be provided on the downstream side. FIG. 10A is a schematic diagram of the configuration viewed from the pressure roller 110. FIG. 10B is a cross-sectional view taken along XB in FIG. 10A including the supporting portion 130S1. The gap filling member 140 includes the upstream sliding portion (the first contact portion) 140*c* and the upstream restricting portion 140*b*, as in the second embodiment. The sandwiched portion 140*a* sandwiched between the heater 113 and the heater holder 130 is wider than the width W1 of the heater 113 to absorb variation, described above. A downstream connecting portion (a third portion) 140*e* and a sliding portion (a second contact portion) 140*f* are respectively similar in shape to the restricting portion 140*b* and the sliding portion 140*c*. The connecting portion 140*e* has a length protruding toward the pressure roller 110, that is, toward the film 112, from a plane α (a sliding surface of the heater 113) of the sliding portion 140*f* perpendicular to the pressing direction a of the pressure roller 110. The plane α includes a corner 113Ed of the downstream wall surface 113Wd of the heater 113. In the present embodiment, the connecting portion 140*e* has a height so that the sliding portion 140*f* protrudes from the plane α by 0.1 mm toward the pressure roller 110. The gap filling member 140 has a corner 140Ed between the connecting portion 140*e* and the sliding portion 140*f* facing the film 112 downstream from the heater 113. The corner 140Ed has a sufficiently smooth shape so that, even if foreign matter conveyed from the upstream side is caught, the film 112 is not damaged.

A groove width W4 between a wall surface 140*b*W of the restricting portion 140*b* and a wall surface 140*e*W of the connecting portion 140*e* in a cross section of the gap filling member 140 in the present embodiment has a variation of ±0.5 mm, like the heater 113 and the heater holder 130. For that reason, the nominal dimension of the groove width W4 is set to 8.1 mm to enable assembly even when the groove width W4 is smallest and the heater width W1 is largest. The other dimensional relationships are the same as those of the second embodiment.

In the present embodiment, the gap filling member 140 is made of aluminum. In the present embodiment, a temperature sensor (not illustrated) for temperature regulation is disposed on a surface of the gap filling member 140 opposite to a surface in contact with the heater 113. A temperature sensor (not illustrated) in the comparative example is disposed so as to be in contact with a surface of the heater 113 opposite to a surface sliding with respect to the film 112.

Forming the gap filling member 140 from a high thermal conductive member is advantageous in increasing the processing speed. In the configuration of the comparative example illustrated in FIG. 4, heat is transferred from the heater 113 to the film 113 only through their sliding portions. In contrast, in the configuration of the present embodiment, heat is transferred to the film 112 through a path via the sandwiched portion 140*a*, the restricting portion 140*b*, and the sliding portion 140*c* and a path via the sandwiched portion 140*a*, the connecting portion 140*e*, and the sliding portion 140*f*. This increases the efficiency of heat transfer from the heater 113 to the film 112, decreasing the temperature of the contact surface of the heater holder 130 in contact with the heater 113 or the gap filling member 140. As a result, even at a temperature lower than the heatproof temperature of the heater holder, large electric power can be applied, so that remarkable speeding up can be achieved.

Table 4 shows comparisons of the results of foreign matter testing in various gap dimensional relationships and processing speeds at which fixing can be performed at the same controlled temperature between the comparative example and the second and third embodiments. The comparative example does not use the gap filling member 140 in the first embodiment, illustrated in FIG. 4. The second embodiment uses aluminum for the gap filling member 140. Without the gap filling member 140, the foreign matter testing could be cleared only with the configuration in which the gap is smallest for variations in dimension of the parts, but could not be cleared with the configuration of nominal dimensions and the configuration of the largest gap. A processing speed at which fixation was enabled while the heat resistance of the heater holder 130 was maintained was 250 mm/sec, and the throughput was 45 ppm. In contrast, in the configuration of the second embodiment in which the gap filling member 140 is disposed only on the upstream side, there was no problem in all of the configurations in which the gap is smallest, the gap has a nominal dimension, and the gap is largest. The processing speed at which the fixing performance is ensured was as high as 267 mm/sec, and the throughput was as high as 48 ppm. This is because a path to transfer heat to the film 112 through the sandwiched portion 140*a*, the restricting portion 140*b*, and the sliding portion 140*c* was formed. Finally, also in the configuration of the third embodiment, there was no problem in the foreign matter testing in all the configurations in which the gap is smallest, the gap has a nominal dimension, and the gap is largest. This is because the dimensional relationship on the gap ΔB is the same as the dimensional relationship of the second embodiment. A processing speed at which the fixing performance is ensured increased to 278 mm/sec, and the throughput increased to 50 ppm. This is because a path to transfer heat to the film 112 through the sandwiched portion 140*a* and the sliding portions 140*c* and 140*f* is added.

TABLE 4

| Configuration | Foreign matter testing | | | Processing speed | Through put |
|---|---|---|---|---|---|
| | Gap smallest | Gap Nominal dimension | Gap largest | | |
| Comparative example | Good | Poor | Poor | 250 mm/sec | 45 ppm |
| Second embodiment | Good | Good | Good | 267 mm/sec | 48 ppm |
| Third embodiment | Good | Good | Good | 278 mm/sec | 50 ppm |

Figure 11A:
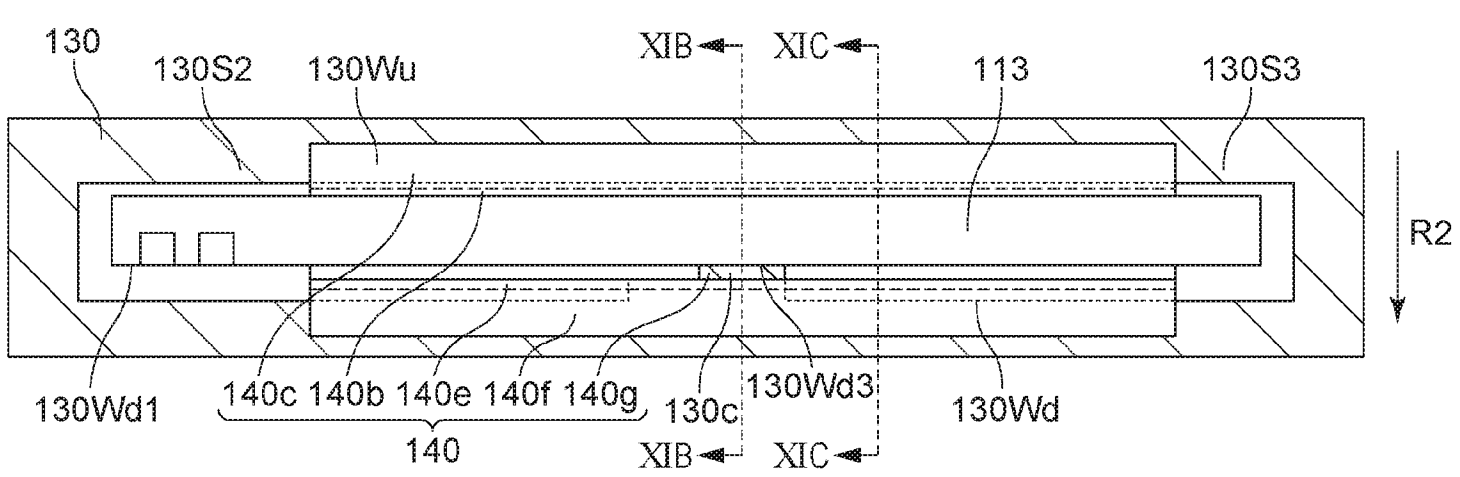
FIG. 11A is a schematic cross-sectional view of part of a fixing apparatus according to a modification of the example third embodiment.
Figure 11B:
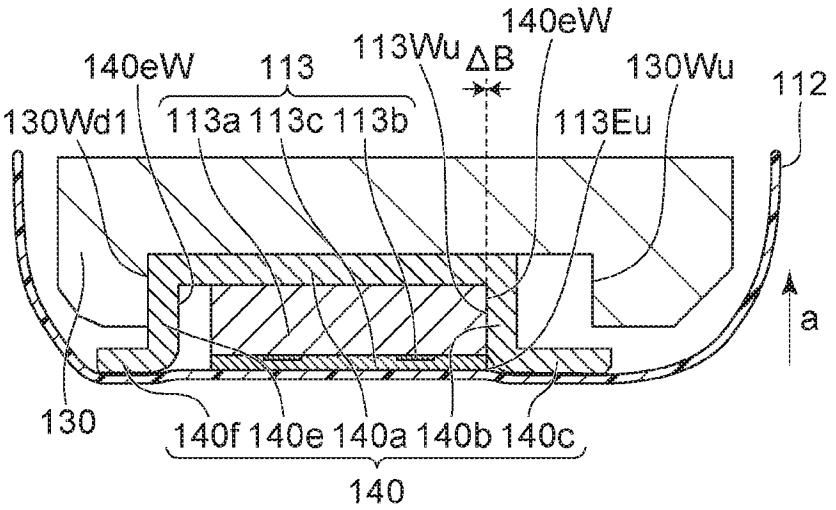
FIGS. 11B and 11C are cross-sectional views of the fixing apparatus in FIG. 11A viewed from the pressure roller.
Figure 11C:
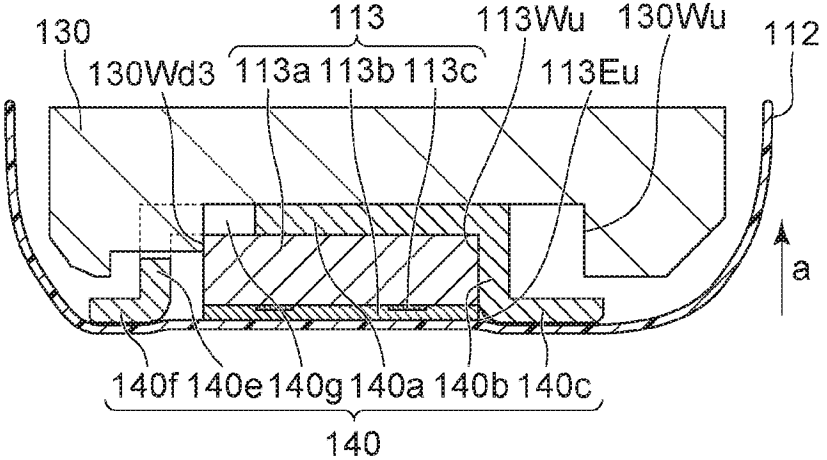

Also in the present embodiment, the positioning portions 130*a* and 130*b* are disposed at both ends, and the supporting portion 130S1 is disposed at the center. Alternatively, the positioning portion 130*c* may be disposed at the center, and the supporting portions 130S2 and 130S3 may be disposed at both ends as in FIG. 11A. In this case, it is necessary to provide a hole (cutout) 140*g* in the connecting portion 140*e* in which the positioning portion 130*c* is fitted. This is because, without the positioning portion 130*c*, the heater 113 can slide until abutting a wall surface 140*e*W of the connecting portion 140*e* of the gap filling member 140, resulting in an increase in ΔB.

In any case, using a jig or the like at assembly allows the gap filling member 140 to be urged downstream against the heater holder 130 for assembly even without the supporting portion 130S1. Without a jig or the like at assembly, adding a spring or the like as in the first embodiment in FIG. 7A allows the gap filling member 140 to be pushed downstream for use. In any configuration, if the upstream side of the film contact portion has a smooth shape as in FIG. 6B of the first embodiment, the sliding portions (film contact portions) 140*c* and 140*f* may not have an L-shape in cross section.

As described above, the fixing apparatus 100 has different cross sections depending on the longitudinal position so that the gap relationship differs between the upstream positioning member and the downstream positioning member, the gap filling member is made of a high heat transfer member, and the downstream positioning portion is in contact with the film. This ensures fixing performance even at a high processing speed in case of variations in dimensions of parts while satisfying assembly performance and resistance to foreign matter at low cost without providing an additional member, applying grease, performing a special work, or using a dedicated jig.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-068244, filed Mar. 30, 2018, which is hereby incorporated by reference herein in its entirety.

What is claimed is:

1. A fixing apparatus comprising:

a holding member including a groove-like holding portion;

a heater supported by the holding portion;

a film rotatable around the heater, the film being configured to be heated by sliding on the heater and to heat a toner image on a conveyed printing material; and a moving member including, on an upstream side with respect to the heater in a conveying direction of the printing material, a first portion disposed between the heater and the holding member and a first contact portion connecting to the first portion and being in contact with the film, wherein, in the conveying direction, the moving member is moveable in the conveying direction and is configured to decrease a second distance between the first portion and the heater so as to be smaller than a first distance between the holding member and the first portion.

2. The fixing apparatus according to claim 1, wherein one end of the first contact portion connects to the first portion, and another end extends upstream from the holding portion of the holding member into contact with the film.

3. The fixing apparatus according to claim 1, wherein the moving member is configured to decrease the second distance by receiving friction from the film.

4. The fixing apparatus according to claim 1, wherein the moving member is configured to make the second distance smaller than the first distance by being urged by an elastic member disposed between the moving member and the holding member.

5. The fixing apparatus according to claim 1, wherein the holding portion of the holding member has a surface inclined in a direction away from the film from the upstream side to a downstream side in the conveying direction, and wherein the moving member is movable to the downstream side along the surface by a force urging the printing material to the film to decrease the second distance.

6. The fixing apparatus according to claim 1, wherein the holding member includes a first positioning portion for restricting a position of the moving member in the conveying direction and a second positioning portion for restricting a position of the heater, and wherein the first positioning portion and the second positioning portion differ in position in a longitudinal direction of the heater.

7. The fixing apparatus according to claim 1, wherein the first contact portion protrudes toward the film with respect to a film slide plane.

8. The fixing apparatus according to claim 1, wherein the moving member is formed from a member having higher thermal conductivity than thermal conductivity of the heater.

9. The fixing apparatus according to claim 8, wherein the moving member includes a second portion connecting to the first portion and disposed between a surface of the heater opposite to a film slide plane and the holding portion, a third portion connecting to the second portion and disposed, on the downstream side of the heater, between the heater and the holding member, and a second contact portion connecting to the third portion and being in contact with the film on the downstream side of the heater.

10. The fixing apparatus according to claim 8, wherein the second contact portion protrudes toward the film with respect to a film slide plane.

11. The fixing apparatus according to claim 1, wherein the second distance is 0.5 mm or less.

* * * * *